United States Patent [19]

Tholander

[11] Patent Number: 4,768,565

[45] Date of Patent: Sep. 6, 1988

[54] METHOD FOR CONTROLLING A YARN STORING, FEEDING AND MEASURING DEVICE

[75] Inventor: Lars H. G. Tholander, Huskvarna, Sweden

[73] Assignee: Aktiebolaget IRO, Ulricehamn, Sweden

[21] Appl. No.: 780,470

[22] Filed: Sep. 26, 1985

[30] Foreign Application Priority Data

| | | | |
|---|---|---|---|
| Sep. 27, 1984 | [SE] | Sweden | 8404847 |
| Oct. 1, 1984 | [SE] | Sweden | 8404907 |
| Oct. 3, 1984 | [SE] | Sweden | 840493 |

[51] Int. Cl.[4] ..... D03D 47/36; B65H 51/20

[52] U.S. Cl. ..... 139/452; 242/47.01

[58] Field of Search ..... 139/452; 242/47.01/47.12, 47.13

[56] References Cited

U.S. PATENT DOCUMENTS

| | | | |
|---|---|---|---|
| 3,918,036 | 11/1975 | Jacobsson | 139/336 |
| 3,971,522 | 7/1976 | Pfarrwaller | 242/47.01 |
| 3,982,568 | 9/1976 | Riha | 139/452 |
| 4,226,379 | 10/1980 | Brouwer | 242/47.01 |
| 4,298,172 | 11/1981 | Hellstrom | 242/47.01 |
| 4,325,520 | 4/1982 | Hintsch | 242/47.01 |
| 4,368,854 | 1/1983 | Valois | 139/452 |
| 4,378,821 | 4/1983 | Umezawa | 139/452 |
| 4,407,336 | 10/1983 | Steiner | 139/452 |
| 4,541,462 | 9/1985 | Tholander | 139/452 |
| 4,556,088 | 12/1985 | Tanaka et al. | 139/452 |
| 4,607,668 | 8/1936 | Tholander | 139/452 |
| 4,627,474 | 12/1986 | Tholander | 139/452 |

FOREIGN PATENT DOCUMENTS

| | | |
|---|---|---|
| 404575 | 7/1966 | Switzerland . |
| 1042868 | 9/1966 | United Kingdom . |
| 1115707 | 5/1968 | United Kingdom . |
| 2107747 | 5/1983 | United Kingdom . |

*Primary Examiner*—Harvey C. Hornsby
*Assistant Examiner*—Joseph S. Machuga
*Attorney, Agent, or Firm*—Flynn, Thiel, Boutell & Tanis

[57] ABSTRACT

The present invention relates to a method for controlling a yarn storing, feeding and measuring device, having a stationary storage drum, a yarn sensor and at least one yarn stopping device, wherein the method includes the determining of the number of pulses which are to be generated by the sensor before actuating the stopping device.

The reliability and speed of the device is enhanced by actuating the stopping device with a pre-determined delay-time after receipt of the pulse, the number of which corresponds to said pre-determined number.

8 Claims, 3 Drawing Sheets

ZS
MEMORY
CU

FIG.3

| PREVIOUS STOPPING DEVICE NO. | NEXT STOPPING DEVICE NO. | NUMBER N OF PULSES | DELAY-TIME $t_d$ (ms) |
|---|---|---|---|
| 1 | 14 | 2 | 5.038 |
| 2 | 15 | 2 | 5.423 |
| 3 | 16 | 2 | 5.808 |
| 4 | 17 | 2 | 6.192 |
| 5 | 18 | 2 | 6.577 |
| 6 | 19 | 2 | 6.962 |
| 7 | 20 | 2 | 7.346 |
| 8 | 21 | 2 | 7.731 |
| 9 | 22 | 2 | 8.115 |
| 10 | 23 | 2 | 8.500 |
| 11 | 24 | 2 | 8.885 |
| 12 | 1 | 3 | 0.038 |
| 13 | 2 | 3 | 0.423 |
| 14 | 3 | 3 | 0.808 |
| 15 | 4 | 3 | 1.192 |
| 16 | 5 | 3 | 1.527 |
| 17 | 6 | 3 | 1.962 |
| 18 | 7 | 3 | 2.346 |
| 19 | 8 | 3 | 2.731 |
| 20 | 9 | 3 | 3.115 |
| 21 | 10 | 3 | 3.500 |
| 22 | 11 | 3 | 3.885 |
| 23 | 12 | 3 | 4.269 |
| 24 | 13 | 3 | 4.654 |

METHOD FOR CONTROLLING A YARN STORING, FEEDING AND MEASURING DEVICE

FIELD OF THE INVENTION

The present invention relates to a method for controlling a yarn storing, feeding and measuring device portion of claim 1.

BACKGROUND OF THE INVENTION

U.S. Pat. No. 4,627,474 WO84/01394 already discloses a very sophisticated technique for controlling a yarn storing, feeding and measuring device. More particularly, this patent discloses a method for controlling a yarn storing, feeding and measuring device for jet looms, having a stationary storage drum onto which a yarn store can be wound by a winding-on device and from which the yarn can be withdrawn, spiralling around the withdrawal end of the storage drum. The device further comprises yarn sensing means arranged such that the yarn is passing a detection area during its withdrawal from the drum which produce pulse signals, each pulse signal indicating a passing of the yarn through the detection area of the sensing means. In addition, it includes a plurality of electromagnetic yarn stopping devices which are arranged at regular angular intervals around the storage drum. Each electromagnetic stopping device includes an electromagnetic coil which can be energised by means of an actuation current generated by a control unit as well as a stopping element which can be moved into the withdrawal path of the yarn when energising the coil for stopping the withdrawal of yarn from the drum. The control unit of the prior art yarn storing, feeding and measuring device includes a memory for storing the positional number of the stopping device actuated at the end of a preceding yean withdrawal cycle which releases the yarn at the beginning of a present yarn withdrawal cycle. On the basis of said information, regarding the positional number, the control unit determines the positional number of the stopping device to be actuated next on the basis of information, regarding the desired yarn length corresponding to the so-called shot length for one weft yarn insertion shot. In other words, the control unit determined how many turns are to be withdrawn from the drum for achieving a desired yarn length, determines the number of complete turns and determines the fraction of the last turn which is necessary for obtaining the desired yarn shot length. Hence, the positional offset of the next yarn stopping device, with respect to the preceding yarn stopping device, can be derived from said fraction of one turn for obtaining information, regarding the positional number of the stopping device to be actuated next. After releasing the previously actuated stopping device, the control unit measures the time from the moment of releasing, derives the actual withdrawn yarn lengths therefrom and periodically adapts the calculated withdrawn yarn length to the actually withdrawn yarn length each time the yarn passes a detection area of the yarn sensor. Assuming that the desired yarn length corresponds to eight and one-half turns of yarn, the calculated yarn length, corresponding to the calculated time since the releasing of the stopping device actuated at the end of a preceding withdrawal cycle, is brought into conformity with the actual length at each passing of the yarn through the detection area of the sensor, e.g. eight times in the present example. After receipt of the eighth pulse from the yarn sensor, the prior art control unit actuates the yarn stopping device, having the positional number which has been derived from the positional number of the yarn stopping device actuated at the end of the previous cycle. However, the prior art system is not adapted for extreme high speeds of the weft yarn during the insertion shot or for controlling a storing, feeding and measuring device, having a storage drum with a very small diameter and, thus, having a very high rotational withdrawal speed at a pre-determined weft yarn insertion velocity.

In view of this state of the art, the present invention is based on the technical task of how to further develop a method of the abovementioned kind so that an exact lengthening of the weft yarn is obtained even when driving the device at extreme velocities.

SUMMARY OF THE INVENTION

In accordance with the present invention, the actuation of the stopping device is delayed with respect to the detection of a predetermined pulse which must not necessarily be the pulse indicating the withdrawal of the last complete turn from the drum. In other words, the present invention teaches to make use of a delay-time after receipt of a pre-determined number of pulses not necessarily corresponding to the number of complete turns to be withdrawn from the storage drum, but which can, for example, be chosen to be a number corresponding to the next to the last turn, which delay-time indicates the time difference between the generation of said pulse and the feeding of an actuation signal to the stopping device. By doing so, it is possible to drive the yarn storing, feeding and measuring device at extremely high speeds or to make use of stopping devices, having a relatively long response time between the feeding of an actuation current to the electromagnetic coil thereof and the termination of the actuation of the stopping element thereof.

The method in accordance with the present invention can be used for a yarn storing, feeding and measuring device, having a stationary storage drum of variable diameter and, preferably, having only a single yarn stopping device. In this case, the delay-time remains the same for different shot lengths, e.g. is independent from the shot length, but depends on the withdrawal speed.

When using the method for a yarn storing, feeding and measuring device, having a stationary storage drum of fixed diameter, and further having a plurality of yarn stopping devices, the delay-time is proportional to the relative position of the respective stopping device to be actuated next with respect to the position of a stopping device, having associated thereto a minimal delay-time. Usually, the stopping device, having associated thereto the minimal stopping time, is located such with respect to the yarn sensor that the feeding of an actuation current to said stopping device at the moment of the passing of the yarn through the detection area of the yarn sensor results in a termination of the actuation of the stopping device at the very moment when the yarn has an angular distance of 180° from the actuated stopping device.

According to a preferred way of implementing the new method, the respective values, regarding the numbers of pulses, the delay-times and the positional numbers of the stopping devices to be actuated at the end of the cycle, are stored in read-only memories in the form of so-called look-up tables which are addressed by inputting the desired shot length and the positional number of the previously actuated stopping device.

BRIEF DESCRIPTION OF THE DRAWINGS

A preferred embodiment will hereinafter be described with reference to the attached drawings in which:

FIG. 3 shows an example of a look-up table defined in a memory of the control unit shown at FIG. 1.

Figure 1:
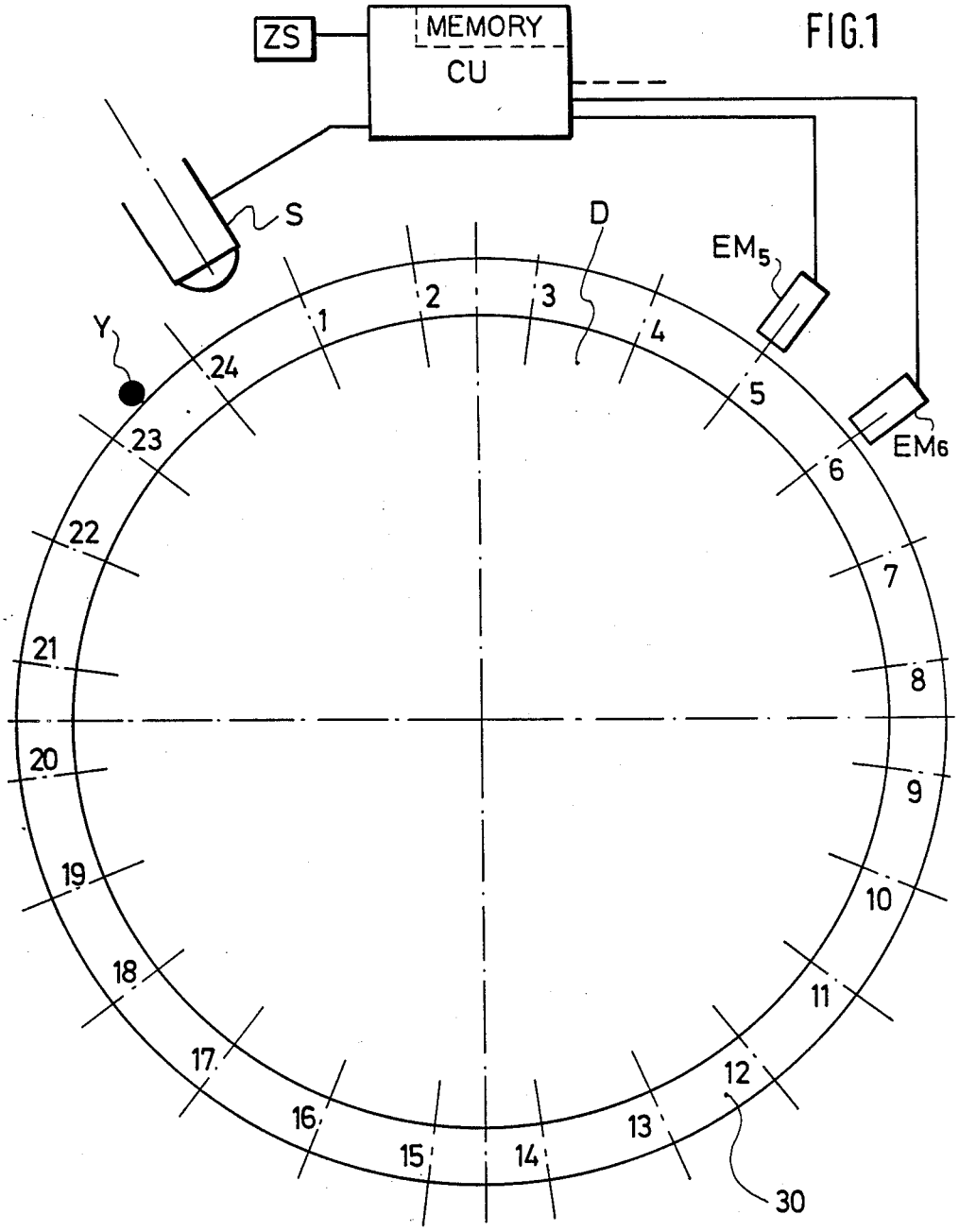
FIG. 1 shows a view against the withdrawal end of a storage drum of a yarn storing, feeding and measuring device.

Yarn storing, feeding and measuring devices of the type shown in FIG. 1 are, per se, known in the art. As far as the structure and circuitry of such a device is concerned, reference is made to the abovementioned prior U.S. Pat. No. 4,627,474. The disclosure of this prior patent is, in the meantime, well known, so that a detailed description of the mechanical structure and of the principles of the mode of operation of a yarn storing, feeding and measuring device can be omitted.

Referring now to FIG. 1, a storage drum D includes a guide ring 30 and a balloon limiting ring (not shown here), defining a gap therebetween which defines the withdrawal path of the yarn Y. Twenty-four stopping devices $EM_1$–$EM_{24}$ are located at regular angular intervals around the outer periphery of the guide ring 30. A yarn sensor S, which is, preferably, of the optical type, including a light emitting element and a light receiving element, is located such that the yarn Y passes the detection area thereof when being withdrawn from the storage drum. In the example shown at FIG. 1, the sensor S is located close to the withdrawal end of the storage drum D. The sensor S and each of the twenty-four stopping devices $EM_1$–$EM_{24}$ (only two of them are shown for reasons of simplicity of the drawings) are connected to a control unit CU. The control unit CU is also connected to a so-called zero sensor ZS. This zero sensor generates a pulse per revolution of the main shaft of the weaving machine.

When feeding an actuation current to one of the stopping devices $EM_1$–$EM_{24}$, a stopping element is moved into the path of the yarn which is withdrawn, spiralling around the withdrawal end of the drum. Hence, the stopping element terminates the withdrawal procedure.

The electronic control unit CU includes a calculating unit, for example, a microcomputer, and a read-only memory, as well as a read-write memory.

During operation, the control unit CU deactuates a stopping device actuated at the end of a preceding withdrawal cycle. Thereinafter, the yarn is freely withdrawn from the drum. During the withdrawal of the yarn, the sensor S generates one pulse per revolution of the withdrawal point of the yarn, passing through the detection area thereof. On the basis of the number of pulses generated by the sensor or on the basis of a calculated withdrawal length, which is periodically refreshed at each generation of a pulse, the number of complete turns withdrawn can be determined. After having counted a certain number of pulses, which will be explained later in more detail, the control unit actuates the stopping device to be actuated next after lapse of a time-delay depending on the positional number of the stopping device to be actuated next. The details will be explained later with reference to FIGS. 2 and 3.

The control unit calculates the positional number of the stopping device to be actuated at the end of the present withdrawal cycle on the basis of information, regarding the stopping device actuated at the end of the previous withdrawal cycle, as well as on the basis of information, regarding the desired yarn length. In this regard, reference is made to the prior patent referred to above.

The basic concept of the present case will be hereinafter described with reference to FIG. 2, which shows a graph of the time-dependent weft yarn length withdrawn from the storage drum D. At the beginning of the weft yarn withdrawal cycle caused by the generation of a zero signal from the zero sensor ZS at the time $t_z$ the previously actuated stopping device $EM_1$–$EM_{24}$ is released. At the time $t_{s1}$ the yarn sensor S generates a first pulse, representing the passing of the yarn Y through the detection area thereof. Further pulses are generated after withdrawing a further revolution of yarn from the drum at the points of time $t_{s2}$, $t_{s3}$, $t_{s4}$ and so on. At the point of time $t_{act}$ the control unit CU feeds an actuation current to the stopping device to be actuated next. After lapse of the response-time $t_R$ of said stopping device $EM_1$–$EM_{24}$ the stopping element thereof reaches its final position at the point of time $t_{pos}$. After lapse of a period of time $t_{0.5}$ required by the yarn Y for running from a position essentially diametrically opposed to the actuated stopping device, e.g. after lapse of a period of time required for withdrawing one half turn of yarn, the yarn comes into contact with the stopping element of the actuated stopping device, resulting in a termination of the weft yarn withdrawal.

Figure 2:
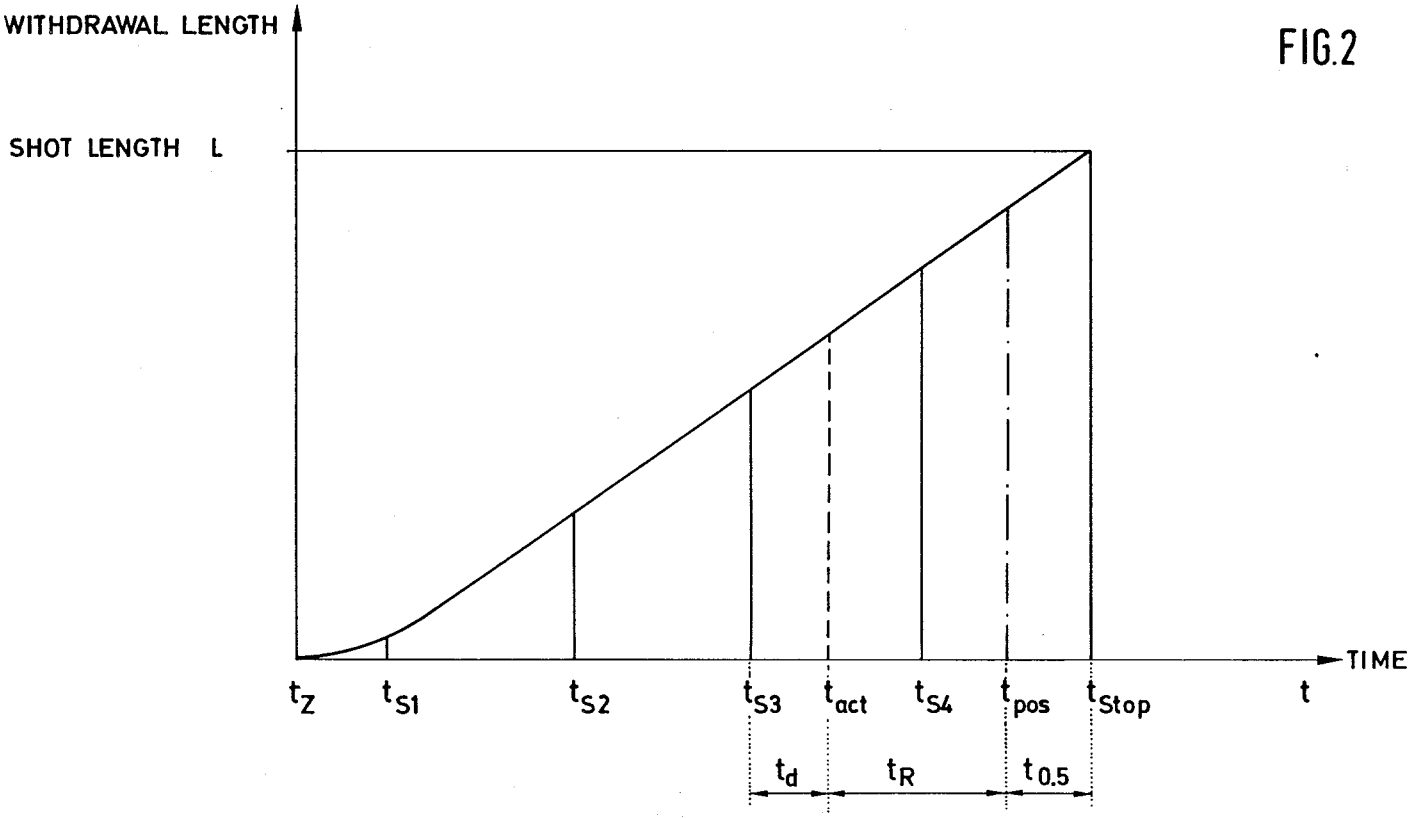
FIG. 2 shows a graph of the time-dependent yarn length withdrawn from the storage drum.

In the example shown in FIG. 2, the stopping device to be actuated at the end of the present withdrawal cycle is supplied with the actuation current before the generation of the last pulse signal by the yarn sensor S at the point of time $t_{s4}$. In the present case, the next to the last pulse signal generated by the sensor S at the point of time $t_{s3}$ causes the actuation of the stopping device to be actuated at the end of the cycle. As will be clear from the subsequent description, the respective "last safe sensor signal", preceding the actuation of the stopping device to be actuated at the end of the withdrawal cycle, depends on the position of the stopping device to be actuated and on the withdrawal speed of the yarn.

For determining the respective "last safe sensor signal" corresponding to the number N of pulses which are to be generated by the sensor before actuating the stopping device, the following calculation is carried out:

(1) Determining the overall weft yar insertion time $t_{stop}$ by dividing the shot length L by the weft yarn insertion speed v.

(2) Reducing the determined insertion time $t_{stop}$ by the response time $t_R$ of the stopping device $EM_1$–$EM_{24}$ and by the period of time $t_{0.5}$ required for withdrawing one half turn of yarn from the storage drum at the weft yarn insertion speed v so as to determine the actuation time $t_{act}$ of the stopping device, indicating the period of time between releasing the previously actuated stopping device and feeding an actuation signal to the stopping device to be actuated next, and (3) Determining the number N of pulses by calculating the number of complete turns of yarn which can be withdrawn from the storage drum up to the calculated actuation time $t_{act}$ at this weft yarn insertion speed v. In the example shown at FIG. 2, the number N of pulses equals three. Thereinafter, the delay-time $t_d$ is determined by subtracting the number N of pulses multiplied by the period of time for the withdrawal of one complete turn of yarn from the drum from the actuation time $t_{act}$.

Preferably, the determination of the respective delay-times depending on the positional number of the stopping device to be actuated next, the positional number of said stopping device itself and the respective numbers N of pulses are pre-determined for each positional number N of the previously actuated device and for the desired shot length L. These pre-determined values are stored in a semi-conductor read-only memory (not shown) of the control unit CU in the form of a look-up table, as shown at FIG. 3.

Such a look-up table has an address-portion corresponding to the positional number of the previously actuated stopping device, a first data column concerning the positional number of the stopping device to be actuated next (as known, per se, in the art), a data column regarding the number N of pulses to be counted before causing the actuation of the next stopping device and an additional data column regarding the respective delay-time $t_d$ between the occurrence of the pulse corresponding to the number N and the generation of an actuation signal fed to the next stopping device.

It is clear to a man skilled in the present technical field that these values depend on the respective desired weft yarn shot length and on the withdrawal speed of the yarn which, in turn, is influenced by features and characteristics of the weaving machine and the yarn itself.

As shown in FIG. 2, the delay-time $t_d$ calculated in the above way causes a termination of the movement of the stopping device to be actuated at the very moment when the withdrawal point of the yarn Y has an actual distance from the actuated stopping device of one half turn. Nevertheless, different delay-times, resulting in distances of the withdrawal point between one-quarter turn and three-quarters of a turn, will also do it.

The principles of the present invention can also be applied to a weft yarn storing, feeding and measuring device, having only a single yarn stopping device, but a stationary storage drum of variable diameter for adjusting the length of the weft yarn to be withdrawn per shot.

In this case, the diameter is determined and adjusted manually in accordance with the desired shot length L. In this case the yarn sensor S is preferably, but not necessarily, located close to the stopping device slightly offset with respect to the stopping device in the direction of the rotational movement of the withdrawal point of the yarn. When using a constant yarn withdrawal speed, a constant delay-time can be set for different shot lengths L. In accordance with the principles of the present invention, it is possible to make use of a device, having a drum with a circumference which is shorter than the withdrawal length of the yarn during the response time $t_R$ of the stopping device. This possibility is caused by the fact that the actuation signal as fed to the stopping device to be actuated must not be generated on the basis of the last signal received from the yarn sensor S during one cycle, since one may make use of the next to the last signal or, if necessary, even an earlier signal from the sensor S, for example, in the case where the measuring device has a small diameter and where the response time $t_R$ of the stopping device is long when compared to the period of time for the withdrawal of one complete turn.

As can be seen from the above, the making use of a delay-time enhances the reliability of the mode of operation of a yarn storing, feeding and measuring device and makes it possible to drive it at higher weft yarn speeds.

The the disclosure of U.S. Pat. No. 4,627,474, mentioned hereinabove, which is hereby incorporated herein by reference.

The embodiments of the invention in which an exclusive property or privilege is claimed are defined as follows:

1. In a method for controlling a yarn storing, feeding and measuring device having a stationary storage drum onto which a yarn can be wound by means of a winding-on device and from which the yarn can be withdrawn, a yarn sensor for detecting the withdrawal of yarn from the drum and for producing a pulse each time the yarn passes a detection area thereof, and a stopping device, including the method steps of determining the number of pulses which are to be generated by the sensor before actuating the stopping device, and counting the pulses generated by the sensor, the improvement comprising the method steps of determining a delay-time which is to begin upon the occurrence of a pulse causing the count to become equal to the determined number of pulses, and actuating the stopping device at the end of the determined delay-time, said determined delay-time depending on the yarn withdrawal speed and on the relative positions of the yarn sensor and the stopping device which is to be actuated;

wherein said yarn storing, feeding and measuring device includes a plurality of said stopping devices, a selected one of said stopping devices being actuated at the end of the said delay-time;

wherein the method step of determining the number of pulses generated by the sensor to be counted before actuating the stopping device which is to be actuated includes the steps of:

inputting a desired shot length;

determining the overall weft yarn insertion time by dividing the shot length by a predetermined weft yarn insertion speed;

determining an actuation time by reducing the determined insertion time by a predetermined response time of the stopping device and by a predetermined period of time required for withdrawing one half turn of yarn from the storage drum at said predetermined weft yarn insertion speed, the actuation time being the period of time between releasing the previously actuated stopping device and supplying an actuation signal to the stopping device to be actuated next, and determining the number of pulses by calculating the number of complete turns of yarn which can be withdrawn from the storage drum during the actuation time at the predetermined weft yarn insertion speed, and wherein the method step of determining the delay-time is carried out by diminishing the determined actuation time by the sum of (1) the determined number of pulses multiplied by a predetermined period of time required for the withdrawal of one complete turn of yarn from the drum at said predetermined insertion speed and (2) the period of time between releasing the previously actuated stopping device and receiving the first pulse from the yarn sensor.

2. A method of controlling a yarn storing, feeding and measuring device which includes a stationary storage drum onto which a yarn can be wound and from which the yarn can be withdrawn by moving circumferentially around one end of the drum, a plurality of stopping devices which are supported at angularly spaced locations about said end of said drum and which when actuated can each stop the circumferential withdrawal movement of the yarn when the yarn is angularly aligned therewith, and a sensor which is provided at a predetermined angular position about said end of said drum and produces a pulse each time the yarn being circumferentially withdrawn passes said sensor, comprising the steps of: associating with each of said stopping devices a respective predetermined number of pulses, a respective predetermined delay-time, and a respective value which identifies one of said stopping devices; and performing a series of successive weft insertions, each said weft insertion including the steps of releasing one of said stopping devices which was actuated at the end of an immediately prior weft insertion, thereafter counting pulses produced by said sensor, thereafter commencing measurement of a time interval upon the occurrence of a pulse from said sensor which causes the count to equal the predetermined number of pulses associated with said released stopping device, said time interval having a length equal to said predetermined delay-time associated with said released stopping device, and actuating at the end of said time interval the stopping device identified by said value associated with said released stopping device.

3. In a method for controlling a yarn storing, feeding and measuring device having a stationary storage drum of fixed diameter, at least two stopping devices provided at angularly spaced locations about said drum for adjusting the length of weft yarn withdrawn per shot, and a yarn sensor for detecting withdrawal of the yarn and for producing a pulse each time the yarn passes a detection area thereof, including the method steps of selecting one of said stopping devices to be actuated at the end of a weft yarn insertion shot on the basis of its position relative to the stopping device actuated at the end of a previous weft yarn insertion shot and on the basis of the desired shot length, determining the number of pulses which are to be generated by the sensor before said selected stopping device is actuated, and counting the pulses generated by the sensor, the improvement comprising the steps of:

assigning to each said stopping device a respective delay-time, one of said stopping devices being assigned a minimal delay-time and the remainder of said stopping devices each being assigned a respective delay-time which is proportional to the angular distance from such stopping device to said one stopping device having assigned thereto said minimal delay-time, determining the delay-time assigned to said selected stopping device, commencing said determined delay-time upon the occurrence of a pulse from said sensor which causes the count to become equal to the determined number of pulses, and actuating said selected stopping device at the end of said determined delay-time.

4. Method for controlling a yarn storing, feeding and measuring device as claimed in claim 3, wherein the method step of determining the number of pulses to be generated by the sensor before actuating the stopping device which is to be actuated after lapse of the determined delay-time includes the steps of:

determining the shot length and insertion speed of a weft yarn, and the period of time required for withdrawing one half turn of yarn from the storage drum at the determined insertion speed, determining the overall weft yarn insertion time by dividing the shot length by the weft yarn insertion speed, determining an actuation time by reducing the determined insertion time by the response time of the stopping device to be actuated and by the period of time required for withdrawing one half turn of yarn from the storage drum at the weft yarn insertion speed, said actuation time being the period of time between releasing the previously actuated stopping device and feeding an actuation signal to the stopping device to be actuated next, and determining the number of pulses by calculating the number of complete turns of yarn which can be withdrawn from the storage drum during the actuation time at the weft yarn insertion speed, and wherein the method step of determining the delay-time is carried out by multiplying the number of pulses by the period of time for the withdrawal of one complete turn of yarn from the drum, and then subtracting the product from the actuation time.

5. Method for controlling a yarn storing, feeding and measuring device as claimed in claim 3, including the step of storing predetermined data in a memory of a control unit of said yarn storing, feeding and measuring device, said predetermined data including for each said stopping device a data set which is accessed following actuation of such stopping device, each said data set including a number of pulses, a delay-time, and an identificatin of which said stopping device is to be actuated next, said predetermined data being empirically predetermined for a predetermined shot length, and wherein said steps of determining a number of pulses and determining a delay-time are carried out by retrieving from said predetermined data in said memory said data set for the stopping device which was most recently actuated.

6. In a method for controlling a yarn storing, feeding and measuring device having a stationary storage drum onto which a yarn can be wound by means of a winding-on device and from which the yarn can be withdrawn, a yarn sensor for detecting the withdrawal of yarn from the drum and for producing a pulse each time the yarn passes a detection area thereof, and a stopping device, including the method steps of determining the number of pulses which are to be generated by the sensor before actuating the stopping device, and counting the pulses generated by the sensor, the improvement comprising the method steps of determining a delay-time which is to begin upon the occurrence of a pulse causing the count to become equal to the determined number of pulses, and actuating the stopping device at the end of the determined delay-time, said determined delay-time depending on the yarn withdrawal speed and on the relative position of the yarn sensor and the stopping device which is to be actuated; wherein said yarn storing, feeding and measuring device includes a plurality of said stopping devices, a selected one of said stopping devices being actuated at the end of said delay-time; including the step of storing predetermined data in a memory of a control unit of said yarn storing, feeding and measuring device, said predetermined data including for each said stopping device a data set which is accessed following actuation of such stopping device, each said data set including a number of pulses, a delay-time and an identification of which said stopping device is to be actuated next, said predetermined data being empirically predetermined for a predetermined shot length, and wherein said steps of determining a number of pulses and determining a delay-time are carried out by retrieving from said predetermined data in said memory said data set for the stopping device which was most recently actuated.

7. Method for controlling a yarn storing, feeding and measuring device as claimed in claim 6, claim 3 or claim 1, wherein each said delay-time is independent from the shot length, but dependent on the withdrawal speed.

8. Method for controlling a yarn storing, feeding and measuring device as claimed in one of the claims 1, 2, and 3, wherein the delay-time is determined such that movement of the stopping device following actuation thereof at the end of the delay-time is completed when the withdrawal point of the yarn has an angular distance therefrom in the range of one-quarter to three-quarters of a turn.

* * * * *

UNITED STATES PATENT AND TRADEMARK OFFICE

CERTIFICATE OF CORRECTION

PATENT NO. : 4 768 565

DATED : September 6, 1988

INVENTOR(S) : Lars H. G. THOLANDER

It is certified that error appears in the above-identified patent and that said Letters Patent is hereby corrected as shown below:

On the title page, change the number of the third listed priority document from "840493" to ---8404934---.

Column 8, lines 35-36; change "identificatin" to ---identification---.

Column 10, line 1; change "1" to ---2---.

Signed and Sealed this

Fourteenth Day of November, 1989

*Attest:*

JEFFREY M. SAMUELS

*Attesting Officer*

*Acting Commissioner of Patents and Trademarks*